US006481484B1

(12) United States Patent
Isshiki

(10) Patent No.: US 6,481,484 B1
(45) Date of Patent: Nov. 19, 2002

(54) LABEL APPLICATOR FOR COMPACT DISC

(75) Inventor: Yuzuru Isshiki, Warabi (JP)

(73) Assignee: Nakagawa Mfg. Co., Ltd., Warabi (JP)

( * ) Notice: Subject to any disclaimer, the term of this patent is extended or adjusted under 35 U.S.C. 154(b) by 0 days.

(21) Appl. No.: 09/599,881

(22) Filed: Jun. 23, 2000

(30) Foreign Application Priority Data

Jun. 25, 1999 (JP) ..... 11-179990

(51) Int. Cl.[7] ..... B65C 1/02

(52) U.S. Cl. ..... 156/556; 156/391; 156/580; 206/308.1

(58) Field of Search ..... 156/391, 556, 156/580, 574, 538; 206/308.1; D6/632

(56) References Cited

U.S. PATENT DOCUMENTS 5,402,882 A * 4/1995 Bandy et al. ..... 206/310
5,951,819 A * 9/1999 Hummell et al. ..... 156/556
6,302,176 B1 * 10/2001 Chen ..... 156/391

FOREIGN PATENT DOCUMENTS

DE 29817456 U1 * 12/1998 ..... B65C/1/02
EP 0855713 A1 * 1/1998 ..... G11B/23/40
JP 2001-10623 A * 1/2001 ..... B65C/1/02

OTHER PUBLICATIONS

Translation of Weinbach–Jackel et al.*

* cited by examiner

*Primary Examiner*—Richard Crispino
*Assistant Examiner*—Sue A. Purvis
(74) *Attorney, Agent, or Firm*—Oblon, Spivak, McClelland, Maier & Neustadt, P.C.

(57) ABSTRACT

A label applicator is provided which can attractively apply an annular label onto a label applying face of a compact disc (CD) by utilizing a CD storage case and a simple attachment. In this label applicator, a CD is stored in a disc storage body of a storage case, having the disc storage body and a lid body attached thereto; and a label attachment, having a label pressing face in almost the same shape as an annular label applying face of the CD, is mounted on the lid body so as to concentrically face these surfaces to each other when the storage case is closed. When the storage case is closed with the label temporarily fixed to the label pressing face, the label is pressed against the opposing label applying face and is then applied thereto.

20 Claims, 6 Drawing Sheets

LABEL APPLICATOR FOR COMPACT DISC

FIELD OF THE INVENTION

The present invention relates to a label applicator for a compact disc (mentioned as CD hereinafter) that permits CD users to easily apply a label onto an annular label applying face of a CD, and a label attachment for use in the label applicator.

DESCRIPTION OF THE RELATED ART

Due to the recent popularity of personal computers, provision of copyright laws and so forth, CD-R (recordable compact discs) and CD-RW (rewritable compact discs) have been used as writable optical recording discs, thus generating the need among users to apply indexes of recorded contents onto these CDs.

In response to this need, there exist apparatuses for particular processing that can print indexes of characters and images by specific printers, but the apparatuses have not yet popularized since they require specific printers.

On the other hand, the popularity of color printers and printer software has resulted in an increasing demand for the application of labels having information printed by general color printers onto the label applying faces of CDs.

However, since the label applying faces of CDs are annular and also large in area, labels are often wrinkled or air is trapped in adhesive faces during the application. Thus, it is difficult to apply labels attractively. As labels are required to be thinner, the application of thinner and more flexible labels will become more difficult.

Additionally, when labels are thickened so as to prevent wrinkles as well as trapped air, CDs will become thicker or will be warped due to the application of labels, causing problems in removal from and placement in storage cases, changes in tonal quality, tracking errors and other problems.

Therefore, it is extremely difficult to attractively apply the thin annular labels printed by printers onto the annular label applying faces of CDs without causing problems.

SUMMARY OF THE INVENTION

The present invention focuses on the high precision of rotatable mounting parts of lid bodies of general storage cases for CDs. An object of the present invention is to provide a label applicator which can attractively apply an annular label onto the annular label applying face of a CD by utilizing a general storage case and using a simple label attachment.

It is also another object of the present invention to provide an economical and easy-to-handle label applicator or the label attachment therefor.

It is still another object of the present invention to provide an easy-to-handle label applicator, keeping a CD as well as a label attachment stored within a CD storage case.

In order to achieve the above objects, the CD label applicator of the present invention has a label attachment in a CD storage case, which has a disc storage body and a lid body attached to the disc storage body in a freely opening and closing condition, thereby applying an annular label to the label applying face of a CD stored in the disc storage body. The label attachment has an annular label pressing face so as to apply a label to the label applying face. The label attachment is mounted on an inner surface of the lid body so as to let the label pressing face concentrically face the label applying face of the CD in the disc storage body and contact against the label applying face by pressing in the lid-closing process.

In this label applicator, a temporary fixing unit may be provided to the label pressing face of the label attachment so as to temporarily fix a label. A guide adapter may be separately mounted concentrically to the center of the label applying face of a CD in the disc storage body so as to locate a temporary fixing position of an annular label to the label applying face. Additionally, the guide adapter may be formed at a height so as to be stored inside the closed storage case. The label attachment may have a center hole, into which the guide adapter is inserted with a space therebetween when the storage case is closed.

It is also preferable that the label pressing face of the label attachment is entirely or partially formed of a cushion layer so as to press a label elastically.

In applying a label to a CD by the above-mentioned CD label applicator, a CD is first stored in the disc storage body of the storage case with the annular label applying face positioned upward; the label attachment constituting the label applicator is mounted on the lid body so as to let the annular label pressing face concentrically face the CD label applying face in the closing process; and a printed side of the annular label having desirable print is temporarily fixed to the label pressing face in a concentric condition.

When the storage case is closed at an engaging part in this condition, the annular label temporarily fixed to the label pressing face is pressed against the annular label applying face of a CD that is concentrically facing the pressing face, so that the label is applied to the label applying face with the adhesive applied to the label.

In this case, if a temporary label fixing unit is provided on the label pressing face, the label temporarily fixed to the label pressing face will stay still when the storage case is closed at the engaging part, so that an annular label may be applied accurately to the label applying face.

Moreover, in case that the label applicator has a guide adapter, a CD is stored in the disc storage body of the storage case; the guide adapter is concentrically mounted onto this CD; and an adhesive side of an annular label having preferable print is temporarily fixed to the label applying face in a concentric condition while this guide adapter is used as a guide.

The above-mentioned temporary fixation of a label is carried out with the guide adapter concentrically fixed to a CD as a guide, so that an annular label may be easily and accurately temporarily fixed to the label applying face in a concentric condition.

Subsequently, in closing the lid body of the storage case to which the label attachment is fixed so as to let the annular label pressing face concentrically face the label applying face of the CD, the annular label temporarily fixed to the label applying face is pressed by the concentrically facing annular label pressing face of the label attachment, so that the label is applied firmly to the label applying face with the adhesive applied to the label.

The storage case is so precise that the engaging part fits well in closing the case, and the label pressing face applies a label while pushing out the air from a gap with the label applying face by gradually pressing from one side of the label diameter to another side, so that these label applicators can apply labels attractively without causing wrinkles and trapped air.

Additionally, if a cushion layer is provided to the label pressing face of the label attachment so as to elastically press labels, this cushion layer elastically presses labels against the label applying face, so that labels may be accurately and more attractively applied to the label applying face.

In the label applicators, a label attachment and so forth are mounted onto a general storage case, so that the structure thereof may be simple and economical. Moreover, annular labels may be attractively applied to annular label applying faces of CDs without forming wrinkles and trapped air.

Moreover, while a label attachment is kept on the lid body of a storage case, a CD may be attached and removed from the disc storage body of the storage case. Moreover, the storage case may be closed. Thus, the handling is very simple.

Furthermore, in case of using a guide adapter, as long as the height thereof is low, a storage case may be closed while a label attachment and the guide adapter are still mounted.

DESCRIPTION OF THE PREFERRED EMBODIMENT

Prior to the embodiments of the present invention, a structure of a storage case 4 for a CD 1, to which an annular label 2 is applied by the label applicator of the present invention (see FIG. 4), will be described. This storage case 4 is for general use.

Figure 10:
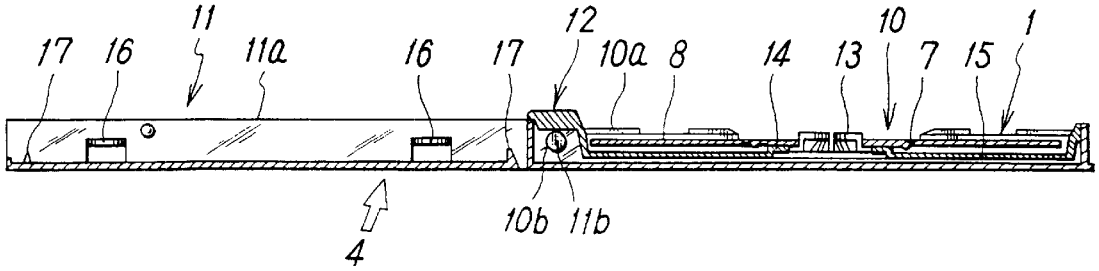
RELATED ART FIG. 10
FIG. 10 is a cross-sectional view of the compact disc storage case shown in FIG. 9.
Figure 9:
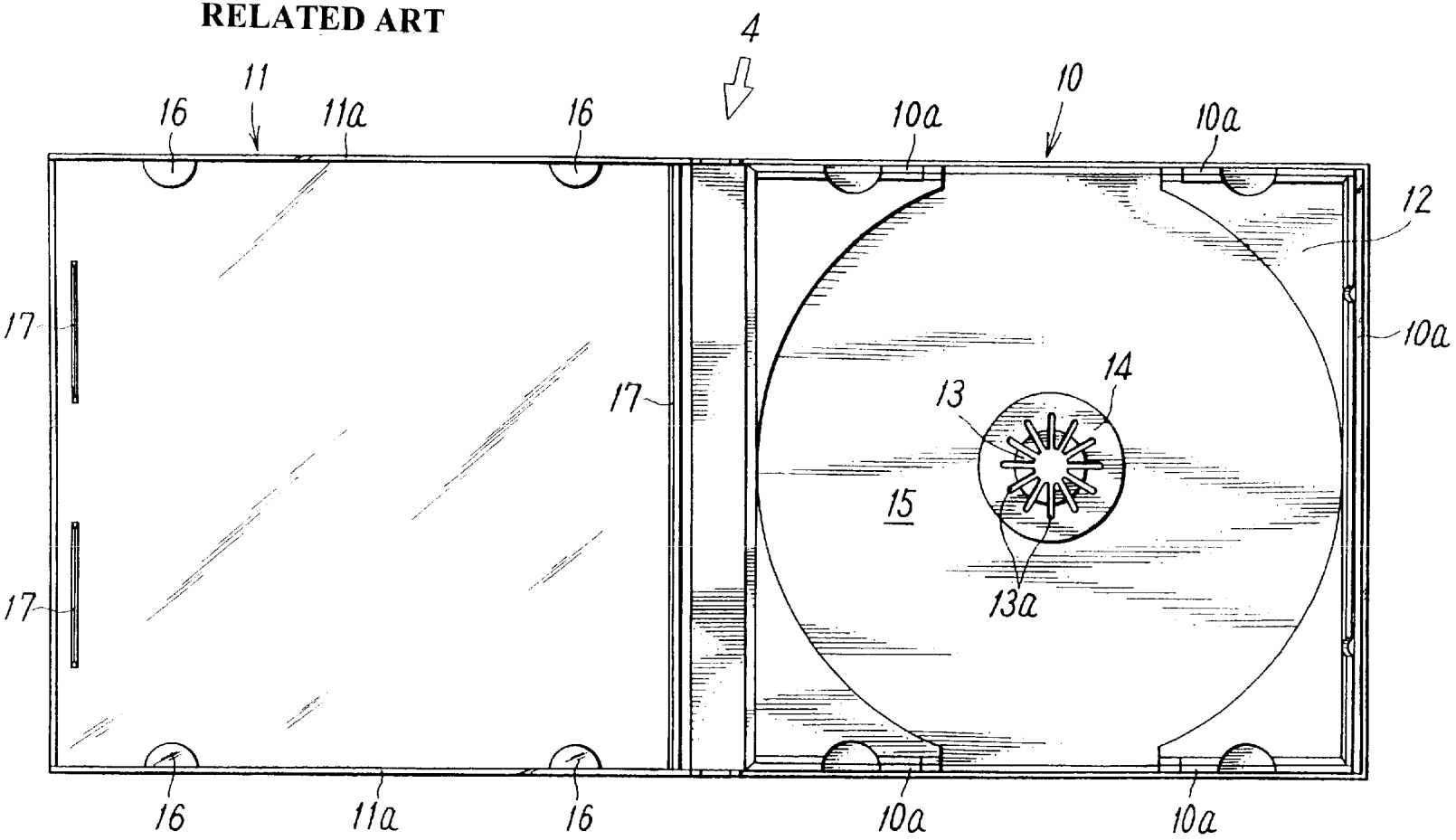
FIG. 9 RELATED ART
FIG. 9 is a top plan view showing an ordinary compact disc storage case.

FIG. 9 and FIG. 10 show an example of the storage case 4. The storage case 4 has a square disc storage body 10 and a square lid body 11.

The disc storage body 10 and the lid body 11 are attached to each other in a freely opening and closing condition by fitting, from the outside, small projections 11*b* at the ends of a pair of opposing sidewalls 11*a* of the lid body 11 on a disc storage body side to small holes 10*b*, formed in the ends of a pair of opposing sidewalls 10*a* of the disc storage body 10 on a lid body side. A tray 12 for storing the CD 1 is fitted inside the disc storage body 10.

In the tray 12, there is provided concentrically an annular fitting projection 13 to which a center hole 6 of the CD 1 is fit, a low and annular protruding portion 14 so as to catch a part surrounding the center hole 6 of the CD 1, and an annular recessed storing portion 15 so as to store the peripheral recording part of the CD 1. At the fitting projection 13 and the center of the annular protruding portion 14, a plurality of notches 13*a* are formed in a radial direction so as to add elasticity to the fitting projection 13. Thus, the CD 1 may be stored in the tray 12 in a removable manner by elastically fitting the center hole 6 thereof to the fitting projection 13.

Pressing pawls 16 are provided inside a pair of the sidewalls 11*a*of the lid body 11 with a slight gap from the lid surface. At both sides of the lid surface orthogonal to the sidewalls thereof, low and straight catching projections 17 are formed. These pressing pawls 16 and catching projections 17 are normally arranged so as to store a description booklet or the like in a retained condition inside the lid body 11.

Moreover, the storage case 4 may not have the tray 12 shown in the figures. Instead, the fitting projection 13, the annular protruding portion 14, the recessed storing portion 15, and so forth may be directly arranged in the disc storage body 10 without the tray 12.

Figure 4:
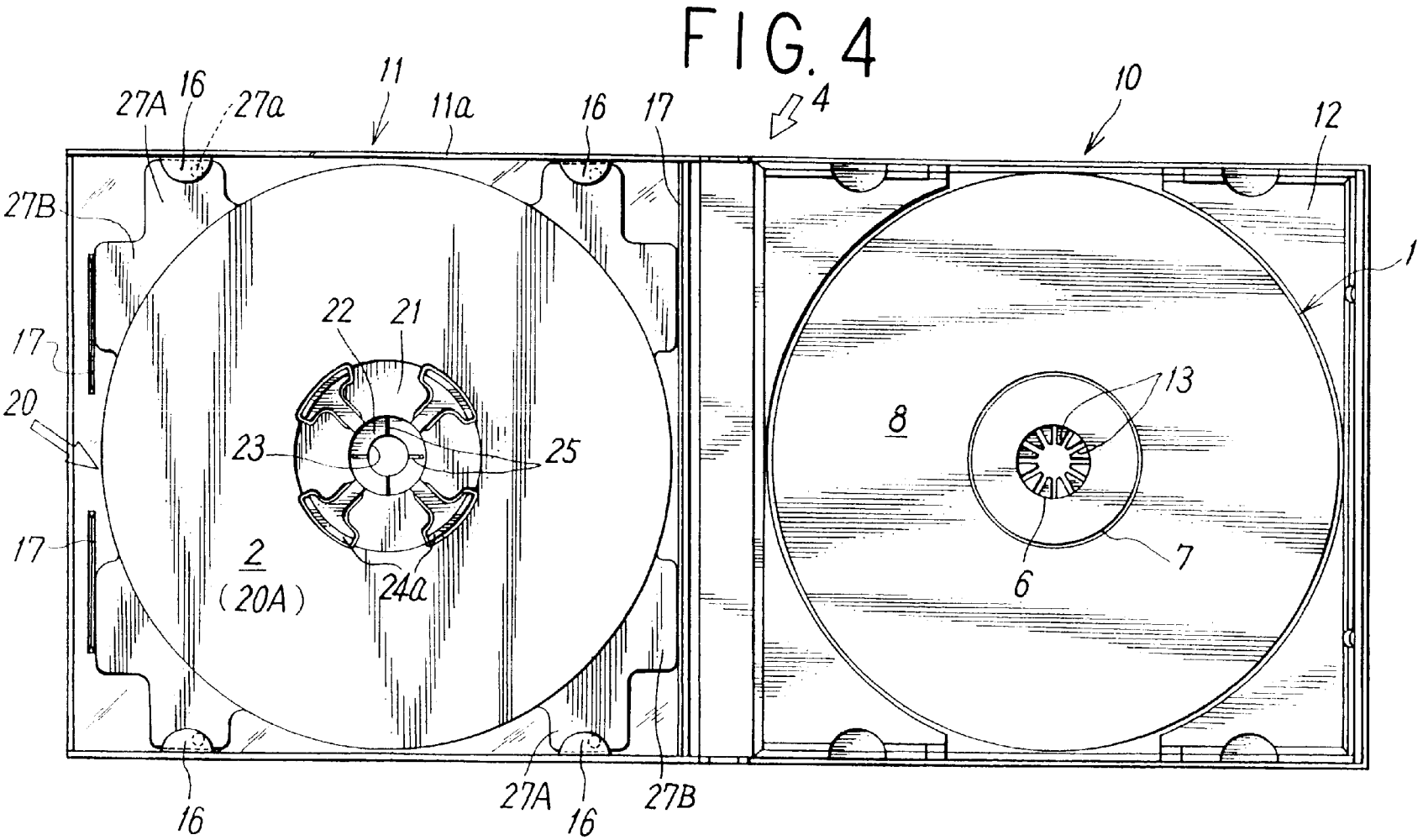
FIG. 4 is a top plan view of a compact disc storage case having a lid body in an open position, showing a CD stored in a disc storage body of the compact disc storage case, and showing the label attachment mounted on the lid body of the compact disc storage case.

As shown in FIG. 4, the CD 1 has the center hole 6 fitted to the fitting projection 13 of the disc storage body 10 at the center, an annular groove 7 in the surface thereof in the outer diameter direction, and an annular label applying face 8 so as to apply a label 2 on the outermost surface thereof. These are formed concentrically. Additionally, information is read and written at the side opposite to the label applying face 8.

Figure 1:
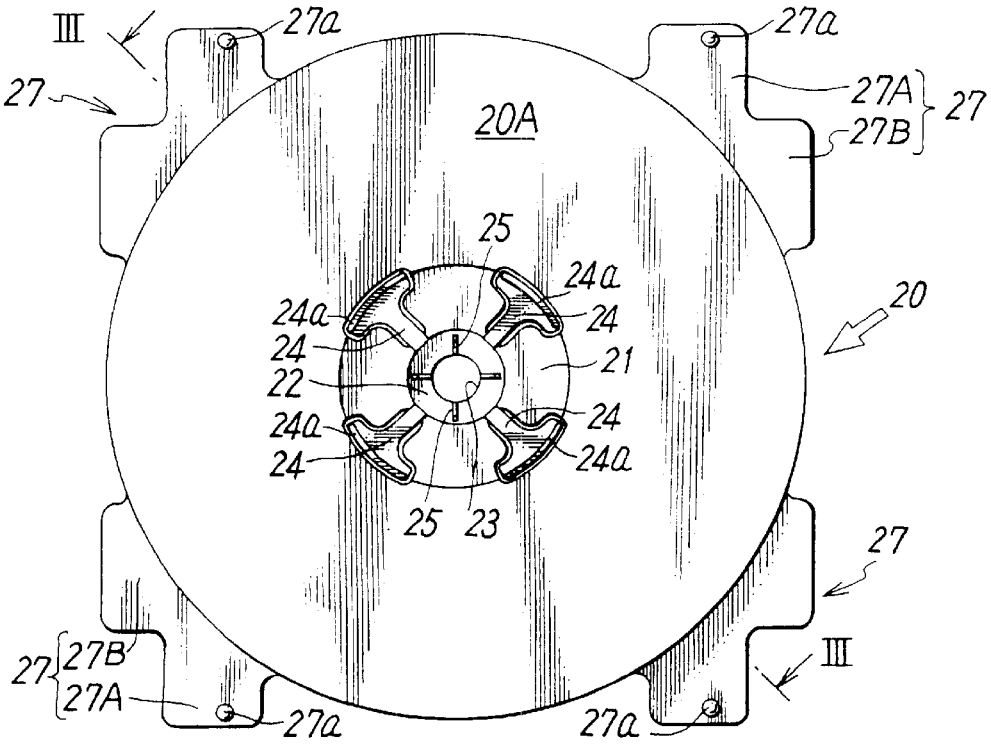
FIG. 1 is a top plan view of a first embodiment of a label attachment according to the present invention.
Figure 2:
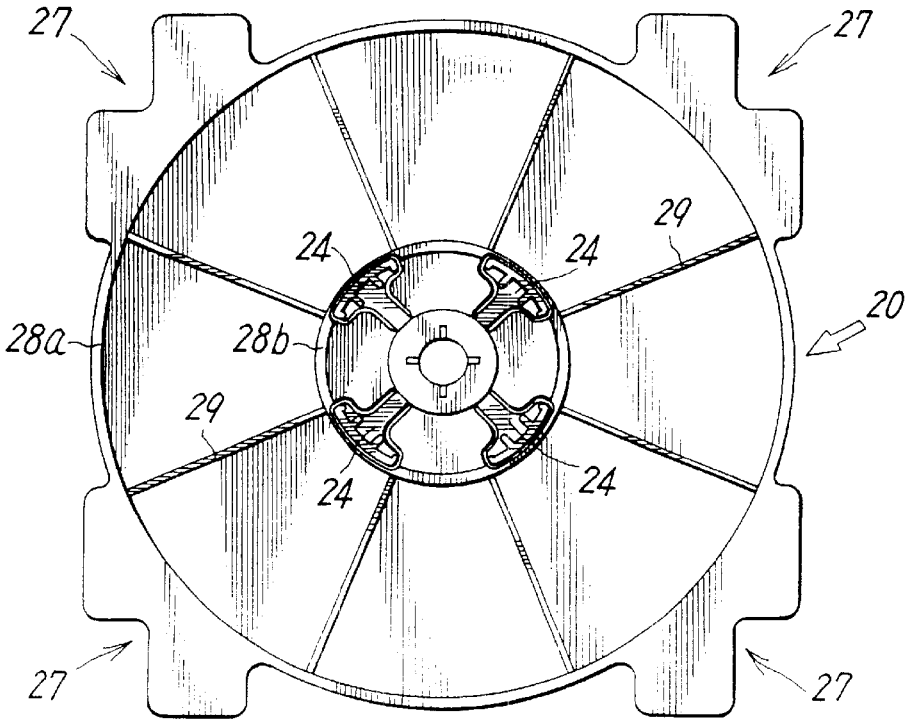
FIG. 2 is a bottom plan view of the same.
Figure 3:
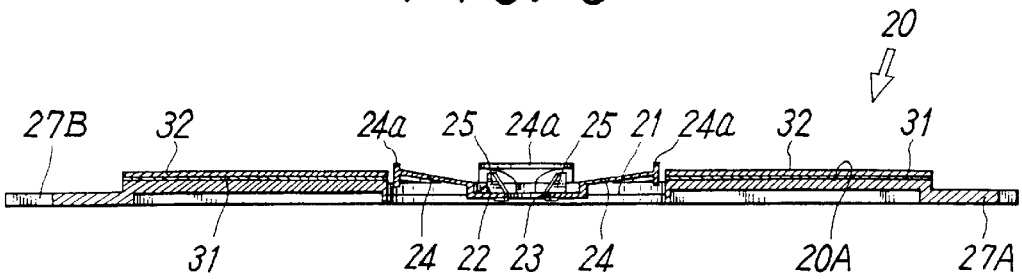
FIG. 3 is a cross-sectional view taken on line III—III of FIG. 1, wherein a cushion layer and a temporary fixing means are provided to a label pressing face.

FIG. 1 to FIG. 3 show a first embodiment of a label attachment of the present invention. As shown in FIG. 4, a label applicator is constructed by storing this label attachment 20 in the storage case as shown in FIG. 9 and FIG. 10. This label attachment 20 is constructed so as to hold the annular label 2, which is applied on the annular label applying face 8 of the CD 1 in the disc storage body 10 and which has roughly the same shape thereof. The label attachment is attached to the lid body 11 of the storage case 4 in a detachable condition.

On the surface of the label attachment 20, as shown in FIG. 1 and FIG. 3, there is concentrically provided, sequentially from outward to center, a plane-shaped label pressing face 20A having roughly the same shape as the label applying face 8 of the CD (FIG. 4), a shallow and annular first recessed portion 21, a second recessed portion 22 slightly deeper than the first, and a central through-hole 23. A plurality (four in the figure) of positioning projections 24 are arranged at the top of the first recessed portion 21. A plurality (four in the figure) of catching projections 25 are provided in a protruding condition at the top of the second recessed portion 22 so as to be inserted and latched in the notches 13*a* when the label attachment 20 is placed over the CD.

The positioning projections 24, which are formed in a T-shape by cutting, are formed in one body so as to slightly undulate the outer edges with elasticity in relation to base edges. Circular catching ridges 24*a*, protruding slightly over the label pressing face 20A, are formed at the tips. These catching ridges 24*a* are inserted to the groove 7 of the CD 1 in the disc storage body 10 when this label attachment 20 is placed over the CD, thereby positioning the label applying face 8 of the CD 1 and the label pressing face 20A of the label attachment 20 so as to face concentrically.

Therefore, when the disc storage body 10 and the lid body 11 are moved circularly with the fitting part as the center so as to close the lid of the storage case 4, the label pressing face 20A concentrically faces the label applying face 8 of the CD 1 in the disc storage body 10. Moreover, the label attachment 20 is mounted on the inner surface of the lid body 11 in a positional relation where the label pressing face 20A is pressed against the label applying face 8 of the CD 1 in the disc storage body 10 when the storage case 4 is closed.

To be mounted on a predetermined location of the lid body 11 of the storage case 4, the label attachment 20 includes, at the four peripheral corners thereof, contacting members 27 having contacting portions 27A to contact the sidewalls 11*a*of the lid body 11, and contacting portions 27B to contact the catching projections 17 on the inner surface of the lid body 11. On the top of the contacting portions 27A, there are provided small projections 27*a* so as to prevent the contacting portions 27B of the label attachment 20, which are stored inside the lid body 11 so as to contact the bottom of the pressing pawls 16, from being placed onto the catching projections 17 on the inside surface of the lid body 11.

Furthermore, circular reinforcing ribs 28*a* and 28*b* are provided in a protruding condition at the inner and outer ridges of the back surface of the annular label pressing face 20A. A plurality (eight in the figure) of reinforcing ribs 29 are provided radially in a protruding condition between these ribs 28*a* and 28*b* on the back surface.

This label attachment 20, as shown in FIG. 4, is firmly mounted on the lid body 11 in a removable condition by inserting the contacting portions 27A under the pressing pawls 16 of the lid body 11 so as to contact the contacting portions 27A and 27B against the sidewalls 11*a* and the catching projections 17, respectively, and to contact the small projections 27*a* against the bottom of the pressing pawls 16.

As shown in FIG. 3, a cushion layer 31 made of paper, nonwoven fabric, soft plastic, rubber, cork or the like is entirely or partially (entirely in the figure) mounted on the label pressing face 20A, if necessary, so as to elastically press the label 2 temporarily fixed at the label pressing face 20A against the label applying face 8 of the CD 1.

Moreover, on the surface of the cushion layer 31, there is provided a temporary fixing unit 32 of a binding layer having weak adhesive strength, an adhesive layer, an adsorption layer having a plurality of minute suction members, or the like so as to temporarily fix the label 2. The binding layer and the adhesive layer should peel completely without being left on the label 2 when the temporary fixed label 2 is peeled off.

Additionally, the disc storage body 10, the lid body 11, the tray 12 and the label attachment 20 of the storage case 4 are individually molded from an appropriate synthetic resin in one body.

For the annular label 2 schematically shown in FIG. 4, general label paper is used that has printing paper with an adhesive on the back surface and separate paper to cover this adhesive. Desirable information such as indexes are printed onto printing paper by conventional printer software.

For application, this label 2 may be one which is cut in roughly the same shape as the annular label applying face 8 after desirable information is printed onto printing paper, or one which is cut in roughly the same shape as the label applying face 8 in advance and then printed with desirable information by a printer.

Subsequently, the use of the label applicator mentioned above will be described by referring to FIG. 4.

First, the label attachment 20 is firmly mounted on the lid portion 11 of the storage case by contacting the contacting portions 27A and the contacting portions 27B against the sidewalls 11*a*and the catching projections 17, respectively, and the small projections 27*a* against the pressing pawls 16. Moreover, the CD 1 is securely stored in the recessed storing portion 15 by fitting the center hole 6 thereof to the fitting projection 13 of the disc storage body 10.

In this condition, the annular label applying face 8 of the CD 1 and the annular label pressing face 20A of the label attachment 20 face each other almost concentrically when the storage case 4 is closed.

Then, the surface (printed side) of the label 2 printed with desirable information such as indexes is concentrically and temporarily fixed to the label pressing face 20A by the temporary fixing means 32 provided at the label pressing face 20A.

In this case, the label 2 having separate paper is thicker than printing paper, so that it is easy to temporarily fix the label to the label pressing face 20A almost concentrically, and wrinkles are not formed at the label 2 by the temporary fixing.

Subsequently, the separate paper is peeled off from this label 2. However, in this case, the label 2 is also temporarily fixed to the label pressing face 20A, so that wrinkles are not formed on the printing paper of the label when the separate paper is peeled off.

When the disc storage body 10 and the lid body 11 are closed at the engaging part thereof as a center so as to close the storage case 4 while the label 2 with the separate paper peeled off is being temporarily fixed to the label pressing face 20A, the plurality of catching ridges 24*a* arranged at the label attachment 20 catch the groove 7 of the CD 1. Additionally, the label pressing face 20A and the label applying face 8 accurately and concentrically face each other, and the label 2 temporarily fixed to the label pressing face 20A is elastically pressed against the label applying face 8 of the CD 1 by the cushion layer 31, so that the label 2 is applied to the label applying face 8 of the CD.

In this case, the temporary fixing unit 32 temporarily fixing the label 2 has weaker adhesive strength or adsorption strength than the adhesive strength of the adhesive applied to the label 2 (adhesive strength of the label>adhesive strength of the temporary fixing unit>adhesive strength of the separate paper), so that the label 2 may be applied to the label applying face 8 without any problems.

Moreover, if necessary, the label 2 may be more securely applied to the label applying face 8 since the disc storage body 10 and the lid body 11 deform slightly with pressure against each other by closing the storing case 4. Since the label pressing face 20A mentioned above is reinforced with the ribs 28*a*, 28*b* and 29, it is hardly warped by the pressure generated from the closure of the storage case 4 or the like and the entire surface of the label 2 may be pressed evenly.

The label 2 may be applied without positional deviations by the label attachment 20 mounted on the storage case 4 under the conditions whereby the label attachment 20 is firmly mounted on the lid body 11, the label applying face 8 and the label pressing face 20A face each other concentrically, and the storage case 4 is closed steadily.

Moreover, by closing the storage case 4, the annular label 2 temporarily fixed to the plane-shaped label pressing face 20A is pressed against the label applying face 8 from one side of the diameter thereof to another side. Subsequently, the label 2 is applied by gradually pushing out the air between the label 2 and the label applying face 8, so that the label 2 may be attractively applied without wrinkles and trapped air.

Furthermore, by closing the storage case 4, the cushion layer 31 provided at the label pressing face 20A presses the label 2 evenly and elastically, so that wrinkles and trapped air are not formed even with a thin label 2, and the label may be applied more attractively onto the label applying face 8.

Figure 5:
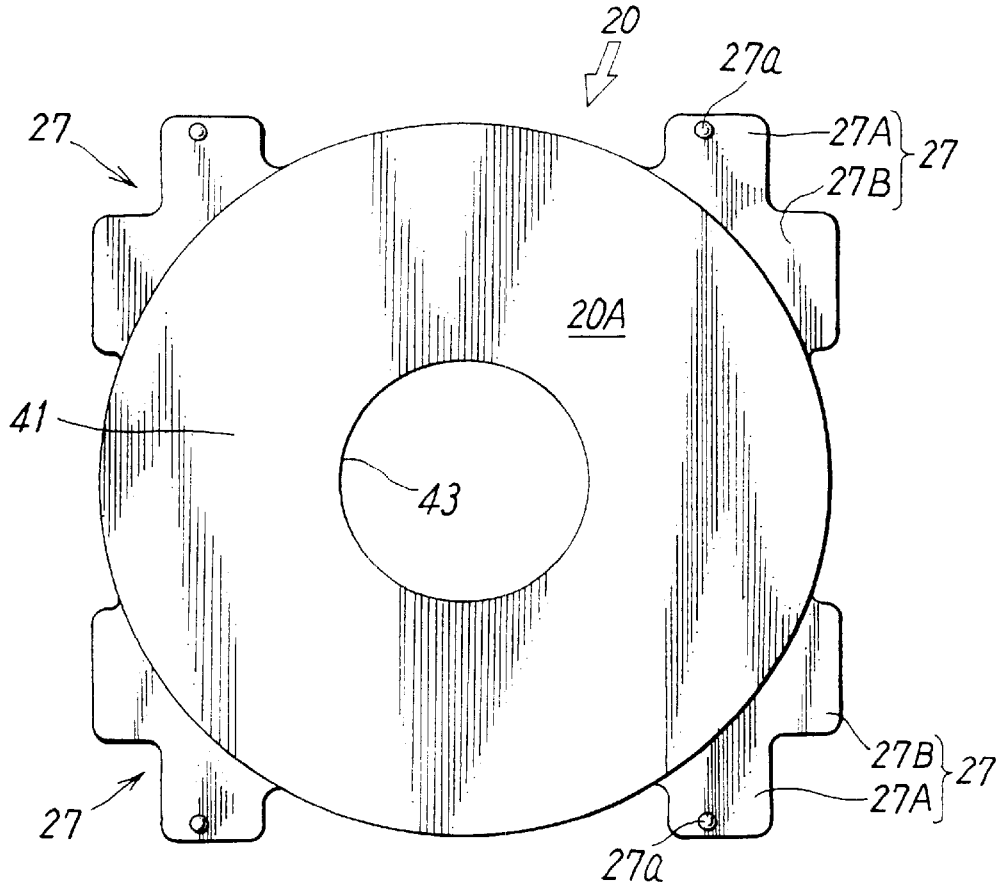
FIG. 5 is a top plan view of a second embodiment of a label attachment.
Figure 6A:
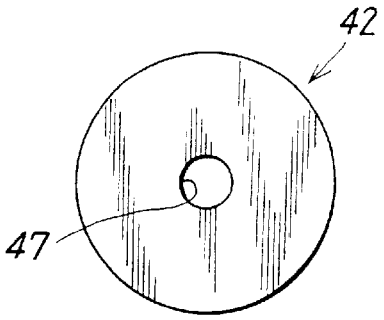
FIG. 6A is a top plan view showing an example of a guide adapter.
Figure 6B:
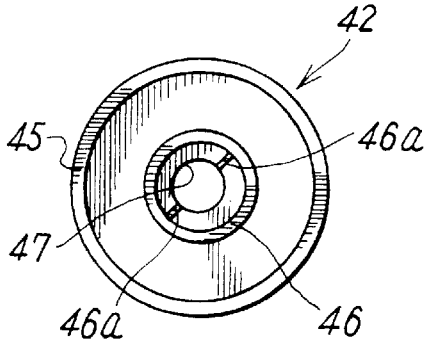
FIG. 6B is a bottom plan view of the guide adapter shown in FIG. 6A.
Figure 6C:
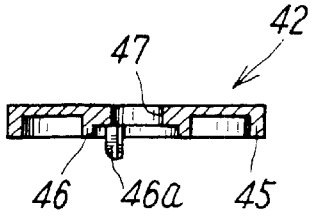
FIG. 6C is a cross-sectional view of the guide adapter shown in FIGS. 6A and 6B.

FIG. 5 shows a second embodiment of a label attachment according to the present invention. FIG. 6A to FIG. 6C show a guide adapter used in the label attachment and a label applicator. In the second embodiment, like in the first embodiment, the storage case 4 shown in FIG. 9 and FIG. 10 is used. However, the storage case includes a label attachment 41 so as to temporarily fix the annular label 2 to the annular label applying face 8 of the CD 1 and then apply the label 2 onto the label applying face 8 by pressing, and a plate guide adapter 42 so as to temporarily position the label 2 to the label applying face 8.

The label attachment 41 includes a center hole 43 where the guide adapter 42, instead of the first and the second recessed parts 21 and 22, is fitted at the center; the center hole 23; and the positioning projections 24 provided at the label attachment 20 of the first embodiment. The label attachment does not include the temporary fixing means 32.

Other elements of the label attachment 41 are the same as those of the label attachment 20 of the first embodiment, so that the same reference numerals are used for the major identical elements in the figure and a detailed description is omitted.

The guide adapter 42 shown in FIG. 6A to FIG. 6C has a plane top surface. There is concentrically provided an annular protruding edge 45 at the outer edge of the bottom surface thereof that catches the annular groove 7 of the CD 1, an annular protruding part 46 at the center thereof, and a center hole 47. Between the annular protruding part 46 and the center hole 47, a plurality (two in the figure) of positioning projections 46*a* are formed so as to be inserted and caught in the notches 13*a* formed at the fitting projection 13 of the disc storing portion 10.

The guide adapter 42 is used so as to position the label 2 when the label is placed on the CD 1 during the application of the label 2. Therefore, the guide adapter has such a height that the storage case 4 can be closed when protruding edge 45 catches the annular groove 7 of the CD 1, and the annular protruding part 46 is formed so as to contact the circumference of the center hole 6.

Accordingly, like the label applicator of the first embodiment, the storage case 4 can be closed under the conditions whereby the CD 1 is stored in the disc storage body 10, the guide adapter 42 is placed onto this CD 1 concentrically, and the label attachment 41 is mounted on the lid body 11.

In applying a label to a CD by the label applicator of the second embodiment, the center hole 6 of the CD 1 is fitted to the fitting projection 13 of the disc storage body 10 and the CD is then stored in the disc storage body 10; and the positioning projections 46*a* of the guide adapter 42 are inserted and then caught in the notches 13*a* provided at the fitting projection 13, thus positioning and placing the guide adapter 42 at a predetermined location on the CD 1. Additionally, like the label attachment 20 in the first embodiment, the label attachment 41 is firmly mounted on the lid body 11.

Moreover, the annular label 2 with separate paper peeled off is concentrically placed on the annular label applying face 8 of the CD 1 while the periphery of the guide adapter 42 is used as a guide. In this case, it is preferable to temporarily fix a portion of the label to the label applying face 8 by the adhesive applied to the label 2. However, that is unnecessary as long as the label is positioned with stability. It is rather not preferable to firmly apply the label 2 onto the label applying face 8 as the firm application causes wrinkles or the like.

When the storage case 4 is closed in this condition or the lid body 11 and the disc storage body 10 are pressed lightly against each other after lid closure, the label 2 temporarily fixed on the label applying face 8 of the CD 1 is elastically pressed against the label applying face 8 with the cushion layer 31 provided at the label pressing face 20A, so that this label 2 is firmly applied onto the label applying face 8.

Other functions of this label applicator are the same as the label applicator of the first embodiment, so that the explanation thereof is omitted.

Figure 7A:
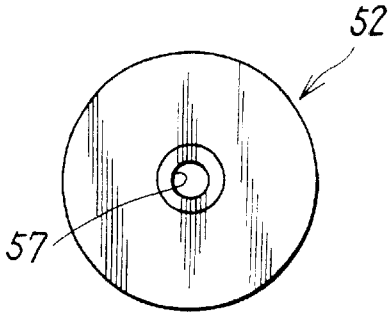
FIG. 7A is a top plan view showing another example of a guide adapter.
Figure 7B:
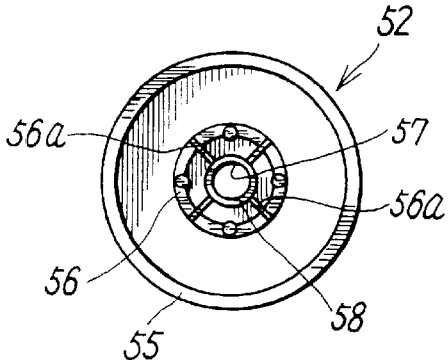
FIG. 7B is a bottom plan view of the guide adapter shown in FIG. 7A.
Figure 7C:
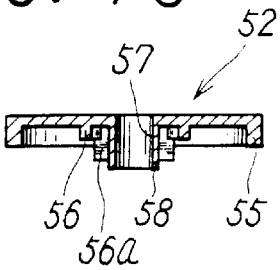
FIG. 7C is a cross-sectional view of the guide adapter shown in FIGS. 7A and 7B.

FIG. 7A to FIG. 7C show another example of a guide adapter used along with the above-mentioned label attachment 41. Much like the guide adapter 42 in FIG. 6, this guide adapter 52 has a roughly plane top surface, an annular protruding edge 55 at the outer edge of the bottom surface thereof, an annular protruding part 56 at the center thereof (lower than the annular protruding part 46) and a center hole 57, which are formed concentrically to each other. A cylindrical part 58 is provided at the circumference of the center hole 57 so as to insert the fitting projection 13 of the disc storage portion 10. At the same time, a plurality (four in the figure) of positioning projections 56*a* are provided in a protruding condition so as to be inserted in the notches 13*a* formed at the fitting projection 13. This guide adapter 52 also has a height so that the storage case 4 can be closed when the protruding edge 55 is caught in the annular groove 7 of the CD 1.

The functions of this example are the same as those of the guide adapter 42, so that the explanation thereof is omitted.

Figure 8A:
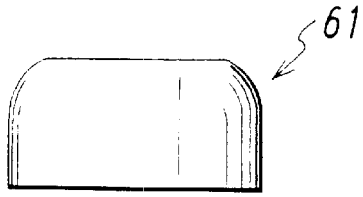
FIG. 8A is a front view showing another example of a guide adapter.
Figure 8B:
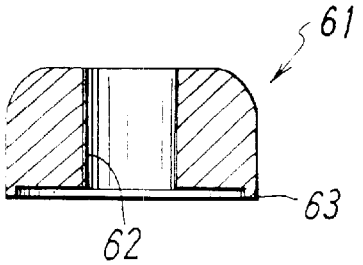
FIG. 8B is cross-sectional view of the guide adapter shown in FIG. 8A.

FIG. 8A and FIG. 8B show another example of the guide adapter mentioned above. Like the example in FIG. 7, this guide adapter 61, instead of the guide adapter 42, is used along with the label attachment 41.

In this guide adapter 61, the peripheral surface at a top portion has a circular cross section and the peripheral surface at a bottom portion is cylindrical; the outer diameter at the bottom end is almost the same as the inner diameter of the groove 7 or the annular label applying face 8 of the CD 1; and a center hole 62 is formed so as to fit the fitting projection 13 of the disc storage body 10 with a space therebetween. However, the center hole 62 of the guide adapter 61 may be a recess instead, in which the fitting projection 13 can fit with a space therebetween. Moreover, this guide adapter 61 has an annular peripheral projection 63 at the periphery of a lower surface so as to be fit and caught in the annular groove 7 of the CD 1.

The guide adapter 61 is higher than the guide adapter 42. If this guide adapter 61 is placed on a CD and the label 2 is placed on the CD with the guide adapter as a guide, the label 2 could be easily and temporarily fixed to the label applying face 8.

However, the guide adapter 61 is high, so that the guide adapter should be removed from the CD 1 prior to the closure of the storage case 4 after the label 2 is temporarily fixed to the label applying face 8.

Other structures as well as functions of this example are the same as those of the second embodiment, so that the explanation thereof is omitted.

What is claimed is:

1. A label applicator for a compact disc comprising:

a label attachment in a compact disc storage case, the compact disc storage case having a disc storage body and a lid body, the lid body being pivotably attached to the disc storage body so as to be pivotable from an open position to a closed position in order to apply an annular label to a label applying face of a compact disc stored in the disc storage body of the compact disc storage case, the label attachment having an annular label pressing face so as to apply the annular label to the label applying face, the label attachment being mounted on an inner surface of the lid body so as to let the annular label pressing face concentrically face and contact against the label applying face of the compact disc stored in the disc storage body when the lid body is pivoted to the closed position in a lid-closing process of the compact disc storage case, and the label attachment including a contacting member at each of four peripheral comers thereof, each of the contacting members having first and second contacting portions forming an approximate L-shape, the first contacting portion of each contacting member contacting a pressing pawl provided so as to extend perpendicularly outwardly from a sidewall of the lid body and the second contacting portion of each contacting member contacting a catching projection located so as to project perpendicularly outwardly from an inside surface of the lid body.

2. The label applicator according to claim 1, wherein the annular label pressing face of the label attachment comprises a temporary fixing means so as to temporarily fix the annular label.

3. The label applicator according to claim 2, wherein the temporary fixing means is either a bonding layer, having weak adhesive strength, or an adhesive layer.

4. The label applicator according claim 3, wherein the annular label pressing face of the label attachment is entirely or partially formed of a cushion layer so as to press the label elastically.

5. The label applicator according claim 3, wherein the label attachment includes positioning projections, which are molded in one body so as to elastically undulate, the positioning projections including catching ridges, which protrude slightly over the annular label pressing face to be inserted in a groove of the compact disc for positioning when the label attachment is placed over the compact disc.

6. The label applicator according claim 2, wherein the annular label pressing face of the label attachment is entirely or partially formed of a cushion layer so as to press the label elastically.

7. The label applicator according claim 2, wherein the label attachment includes positioning projections, which are molded in one body so as to elastically undulate, the positioning projections including catching ridges, which protrude slightly over the annular label pressing face to be inserted in a groove of the compact disc for positioning when the label attachment is placed over the compact disc.

8. The label applicator according to claim 1, further comprising a guide adapter which is separately mounted concentrically to a center of the label applying face of the compact disc stored in the disc storage body so as to locate a temporary fixing position of the annular label to the label applying face of the compact disc.

9. The label applicator according to claim 8, wherein the guide adapter is formed to have a height so as to be stored inside the compact disc storage case when the lid body is in the closed position and wherein the label attachment has a center hole, into which the guide adapter is inserted with a space therebetween when the lid body of the compact disc storage case is in the closed position.

10. The label applicator according claim 9, wherein the annular label pressing face of the label attachment is entirely or partially formed of a cushion layer so as to press the label elastically.

11. The label applicator according claim 9, wherein the label attachment includes positioning projections, which are molded in one body so as to elastically undulate, the positioning projections including catching ridges, which protrude slightly over the annular label pressing face to be inserted in a groove of the compact disc for positioning when the label attachment is placed over the compact disc.

12. The label applicator according claim 8, wherein the annular label pressing face of the label attachment is entirely or partially formed of a cushion layer so as to press the label elastically.

13. The label applicator according claim 8, wherein the label attachment includes positioning projections, which are molded in one body so as to elastically undulate, the positioning projections including catching ridges, which protrude slightly over the annular label pressing face to be inserted in a groove of the compact disc for positioning when the label attachment is placed over the compact disc.

14. The label applicator according claim 1, wherein the annular label pressing face of the label attachment is entirely or partially formed of a cushion layer so as to press the label elastically.

15. The label applicator according to claim 1, wherein the label attachment includes positioning projections, which are molded in one body so as to elastically undulate, the positioning projections including catching ridges, which protrude slightly over the annular label pressing face to be inserted in a groove of the compact disc for positioning when the label attachment is placed over the compact disc.

16. A label attachment mounted on a lid body of a compact disc storage case, the compact disc storage case including a disc storage body and the lid body, the lid body being pivotably attached to the disc storage body so as to be pivotable from an open position to a closed position in order to apply an annular label to a label applying face of a compact disc stored in the disc storage body, the label attachment comprising:

an annular label pressing face so as to apply the annular label to the label applying face; and contacting members at each of four peripheral comers thereof, each of the contacting members having first and second contacting portions forming an approximate L-shape, the first contacting portion of each contacting member contacting a pressing pawl provided so as to extend perpendicularly outwardly from a sidewall of the lid body and the second contacting portion of each contacting member contacting a catching projection located so as to project perpendicularly outwardly from an inside surface of the lid body so as to concentrically face the annular label pressing face to the label applying face of the compact disc for positioning.

17. The label applicator according claim 16, wherein the annular label pressing face of the label attachment comprises a temporary fixing means so as to temporarily fix the annular label.

18. The label applicator according claim 17, wherein the temporary fixing means is either a bonding layer, having weak adhesive strength, or an adhesive layer.

19. The label applicator according claim 16, wherein the annular label pressing face of the label attachment is entirely or partially formed of a cushion layer so as to press the label elastically.

20. The label applicator according claim 16, wherein the label attachment includes positioning projections, which are molded in one body so as to elastically undulate, the positioning projections including catching ridges, which protrude slightly over the annular label pressing face to be inserted in a groove of the compact disc for positioning when the label attachment is placed over the compact disc.

* * * * *